US011511829B2

(12) United States Patent
Coney et al.

(10) Patent No.: US 11,511,829 B2
(45) Date of Patent: *Nov. 29, 2022

(54) SYSTEM AND METHOD FOR UNDERWAY AUTONOMOUS REPLENISHMENT OF SHIPS

(71) Applicant: RAYTHEON BBN TECHNOLOGIES, CORP., Cambridge, MA (US)

(72) Inventors: William Bowles Coney, Watertown, MA (US); John Philip Granville, Bedford, MA (US); Edin Insanic, Belmont, MA (US)

(73) Assignee: RAYTHEON BBN TECHNOLOGIES CORP., Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/447,667

(22) Filed: Sep. 14, 2021

(65) Prior Publication Data

US 2022/0009596 A1 Jan. 13, 2022

Related U.S. Application Data

(63) Continuation of application No. 16/889,631, filed on Jun. 1, 2020, now Pat. No. 11,161,572.

(51) Int. Cl.
*B63B 27/30* (2006.01)
*B63B 27/32* (2006.01)
(Continued)

(52) U.S. Cl.
CPC ..... *B63B 27/30* (2013.01); *B63B 27/32* (2013.01); *B63B 22/00* (2013.01); *B63B 27/34* (2013.01)

(58) Field of Classification Search
CPC ..... B63B 21/56; B63B 27/26; B63B 27/24; B63B 27/30; B63B 27/32; B63B 22/00; B63B 27/34
(Continued)

(56) References Cited

U.S. PATENT DOCUMENTS 3,296,995 A 1/1967 Van Der Linde
3,440,671 A 4/1969 Smulders
(Continued)

FOREIGN PATENT DOCUMENTS

EP 0 613 438 B1 1/1997
GB 2561780 A 10/2018
WO WO 2017/086780 A1 5/2017

OTHER PUBLICATIONS

International Search Report for corresponding International Application No. PCT/US2021/026653, filed Apr. 9, 2021, International Search Report dated Nov. 18, 2021 and dated Nov. 25, 2021 (5 pgs.).
(Continued)

*Primary Examiner* — Gregory W Adams
(74) *Attorney, Agent, or Firm* — Lewis Roca Rothgerber Christie LLP

(57) ABSTRACT

An autonomous loading/unloading system and method for transferring material includes: a buoy for releasing onto water; a messenger line coupled to the buoy for being pulled; a carrier line loop coupled to the messenger line for being pulled, where a payload is coupled to the carrier loop for transferring the material to or from an unmanned ship; a fetch/release platform to fetch or release the payload from or onto the water; a loading/unloading dock for the payload; a plurality of line guides for guiding the carrier loop; and a platform-to-payload interconnect for autonomous loading or unloading of the material from/to the payload.

20 Claims, 8 Drawing Sheets

(51) Int. Cl.
*B63B 22/00* (2006.01)
*B63B 27/34* (2006.01)

(58) Field of Classification Search
USPC ..... 414/142.8, 142.7, 142.6, 137.8, 137.7
See application file for complete search history.

(56) References Cited

U.S. PATENT DOCUMENTS

| | | | |
|---|---|---|---|
| 3,572,408 | A | 3/1971 | Hnot |
| 3,595,195 | A | 7/1971 | Van Eek et al. |
| 3,727,650 | A | 4/1973 | Ingram et al. |
| 3,766,938 | A | 10/1973 | Stracke et al. |
| 4,273,066 | A | 6/1981 | Anderson |
| 4,762,456 | A | 8/1988 | Nelson |
| 6,010,295 | A | 1/2000 | Sridhar |
| 8,328,467 | B2 | 12/2012 | Thompson et al. |
| 8,831,393 | B2 | 9/2014 | Jung |
| 8,991,447 | B1 | 3/2015 | Petersen |
| 9,017,123 | B2 | 4/2015 | Szydlowski et al. |
| 9,096,294 | B1 | 8/2015 | Dong et al. |
| 10,604,220 | B2 | 3/2020 | Sakaue et al. |
| 11,161,572 | B1 * | 11/2021 | Coney ..... B63B 27/30 |
| 2011/0168075 | A1 | 7/2011 | Yemm et al. |
| 2018/0327057 | A1 | 11/2018 | Pastor et al. |

OTHER PUBLICATIONS

Written Opinion of the International Searching Authority for corresponding International Application No. PCT/US2021/026653, filed Apr. 9, 2021, Written Opinion of the International Searching Authority dated Nov. 25, 2021 (6 pgs.).

* cited by examiner 506b
508
506
510a
506a
504
510b
506a
506b
506
508
512
502
512

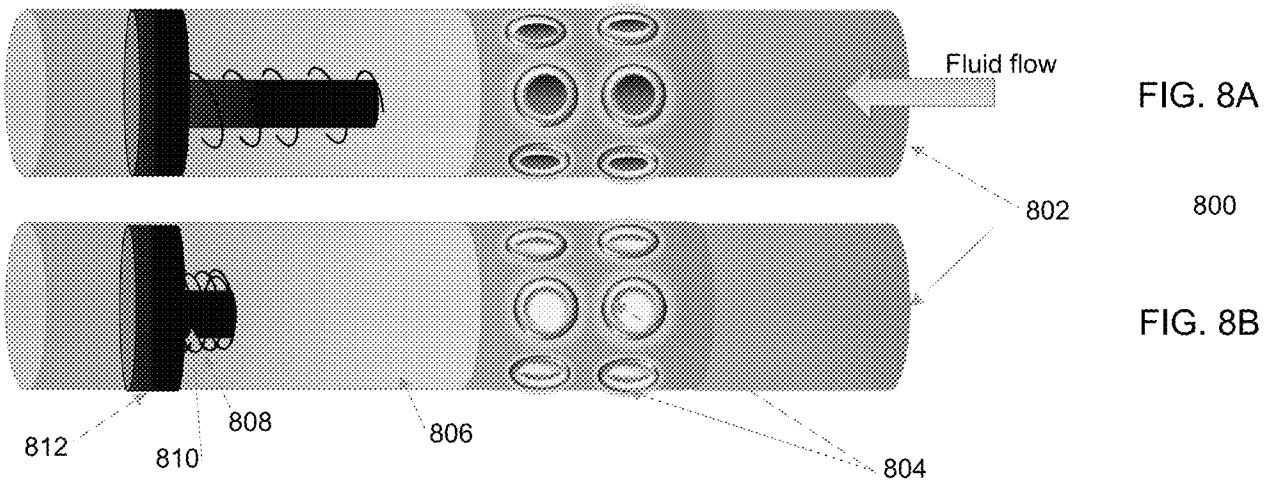
FIG. 8A
800
FIG. 8B
Fluid flow
802
804
806
808
810
812
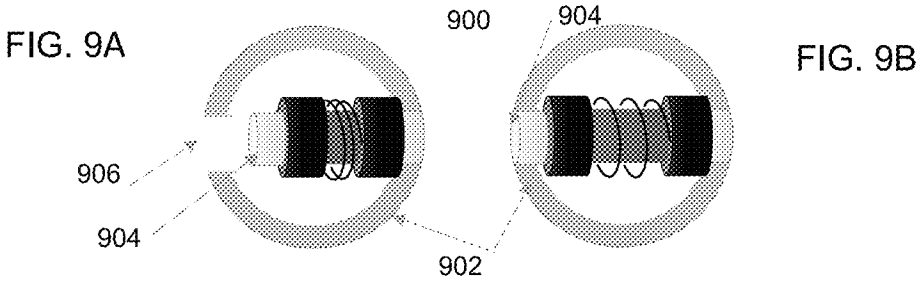
FIG. 9B
904
900
902
906
904
FIG. 9A

SYSTEM AND METHOD FOR UNDERWAY AUTONOMOUS REPLENISHMENT OF SHIPS

CROSS-REFERENCE TO RELATED MATTERS

This is a continuation application of U.S. patent application Ser. No. 16/889,631, filed Jun. 1, 2020, entitled "System and Method for Underway Autonomous Replenishment of Ships;" the entire contents of which are hereby expressly incorporated herein by reference.

FIELD OF THE INVENTION

The disclosed invention relates generally to autonomous material transfer between moving ships and more specifically to a system and method for underway autonomous replenishment of ships.

BACKGROUND

At-sea ship replenishment is a key naval capability that enables ships to perform trips or missions lasting months or years at-sea without coming back to a port. Many sea ships routinely carry out such replenishment for both fuel and material between sending and receiving ships that 1) match course and speed, 2) manually exchange a cable between the ships, and manually (non-autonomous) 3) pull material (or a hose in the case of refueling) suspended from that cable from the sending to receiving ship.

For example, in a conventional method known as astern fueling, a line and buoy is floated behind the sending ship to be recovered by the receiving ship. A floating hose is then manually pulled across and manually used to convey fuel pumped from the sending to the receiving ship.

Unmanned ships or unmanned surface vehicles (USVs) are ships that operate on the surface of the water without a crew. Advances in USV control systems and navigation technologies have resulted in USVs that can be operated remotely (by an operator on land or on a nearby vessel), operated with partially autonomous control, or operated fully autonomously. Some applications and research areas for USVs include commercial shipping, environmental and climate monitoring, seafloor mapping, passenger ferries, robotic sea/ocean research, surveillance, inspection of sea structures such as bridges and off-shore oil facilities and other infrastructure, military, and naval operations.

USVs are also valuable in oceanography, as they are more capable than moored or drifting weather buoys. Moreover, powered USVs are powerful tools for use in hydrographic survey. Some military applications for USVs include powered seaborne targets, mine hunting/sweeping and surveillance.

With the development of unmanned technology, development of USV has been progressing actively in order to perform marine operations that are dangerous and inefficient when being performed by a manned vessel, such as, sea mine sweeping, maritime investigation, marine reconnaissance and surveillance, marine accident response, and the like. Many applications of the unmanned ships require that the vessels operate without human intervention for months or longer at sea, similarly requiring replenishment at sea to enable their long missions.

The conventional methods for the replenishment of unmanned ships generally entail physically docking with a host ship, pier, dock, buoy, etc. and manually supplying the material to the unmanned ship.

SUMMARY

In some embodiments, the disclosed invention is a system and method for the underway replenishment or unloading of an unmanned ship in which the complexity of navigational operations, controls and mechanical systems onboard the unmanned ship are minimized.

In some embodiments, the disclosed invention is an autonomous loading or unloading system on an unmanned ship for transferring material to or from a sending ship. The system includes: a buoy for releasing onto water by the unmanned ship; a messenger line coupled to the buoy for being pulled by the sending ship; a carrier line loop coupled to the messenger line for being pulled by the sending ship, where a payload is coupled to the carrier loop for transferring the material to or from the unmanned ship; and a fetch/release platform to fetch or release the payload from or onto the water. The system further includes: a loading/unloading dock for the payload; a plurality of line guides for guiding the carrier loop, wherein the carrier line loop is looped around the line guides and is pulled by the sending ship in a first direction to move the payload from the sending ship to the unmanned ship, and pulled in a second direction opposite to the first direction to move the payload from the unmanned ship to the sending ship; and a platform-to-payload interconnect for autonomous loading or unloading of the material from/to the payload.

In some embodiments, the disclosed invention is an autonomous method for loading or unloading material on or from an unmanned ship. The method includes: autonomously releasing a buoy onto water by the unmanned ship; pulling a messenger line coupled to the buoy by a sending ship; pulling a carrier line loop coupled to the messenger line, wherein a payload is coupled to the carrier loop for transferring the material; autonomously fetching or releasing the payload from or onto the water by a fetch/release platform; autonomously guiding the carrier loop by a plurality of line guides, wherein the carrier line loop is looped around the line guides and is pulled in a first direction to move the payload from the sending ship to the unmanned ship, and pulled in a second direction opposite to the first direction to move the payload from the unmanned ship to the sending ship; and autonomously loading or unloading the material from/to the payload via a platform-to-payload interconnect.

The payload may be a capsule for transferring containerized or crated material; a hose for transferring fluid; or a conducting cable having a first cable terminal contact area and a second cable terminal contact area for transferring electrical energy.

BRIEF DESCRIPTION OF THE DRAWINGS

These and other features, aspects, and advantages of the disclosed invention will become better understood with regard to the following description, appended claims, and accompanying drawings.

FIGS. 8A and 8B depict an exemplary inline valve for autonomous dispensing fluid, according to some embodiments of the disclosed invention.

FIGS. 9A and 9B illustrate an exemplary perpendicular valve for autonomous dispensing fluid, according to some embodiments of the disclosed invention.

DETAILED DESCRIPTION

In some embodiments, the disclosed invention is a system and method for the underway replenishment of a moving unmanned ship ("receiving ship") by a "sending ship," without having the unmanned ship to port or stop. The sending ship may have crews or may be unmanned as well.

In some embodiments, the unmanned receiving ship is commanded to maintain a constant course and speed. The sending ship maneuvers as necessary to carry out the replenishment operation. This minimizes the navigation and ship maneuvering control that need be carried out by the unmanned (receiving) ship. The only other actions to be taken by the unmanned receiving ship are a) to autonomously release a messenger line and buoy at the start of the transfer operation, b) to autonomously recover a carrier (loop) line and the messenger line at the conclusion of the operation, and c) autonomously handle any transferred material once onboard the unmanned ship.

In some embodiments, the material transfer operation is conducted from the stern of the sending ship and all complex line handling is performed on the sending ship. The sending ship is equipped with all of the large equipment elements and their controls associated with the transfer, including powerful winch(es) needed to pull across the transfer material, an enclosing payload for example, a payload, a strong and buoyant haul rope (cable), electrical cables or hoses and pumps in the case of fluid transfer, and the materials to be transferred. The payload may be a capsule or casing for containerized or crated material such as batteries or ammunition; a hose for transferring fluid such as fuel or water; and/or a conducting cable for transferring electric energy, for example, for charging batteries on the unmanned ship.

In some embodiments, the transfer is received over the bow of the unmanned receiving ship. The unmanned receiving ship is equipped with a small buoy with an attached length of lightweight messenger line, which is optionally attached to another stronger buoyant line forming a carrier loop with ends attached to each other by, for example, split rings. The messenger line and the carrier loop are sufficiently long to provide safe separation between the ships, for example, 50 meters. The loop is maintained by paired pulleys or rollers that can automatically adjust to varying line thickness. The receiving ship also includes a rope windlass to recover the carrier loop, and whatever equipment is need to handle and utilize the transferred material once it has arrived onboard.

Figures 1A, 1B, 1C:
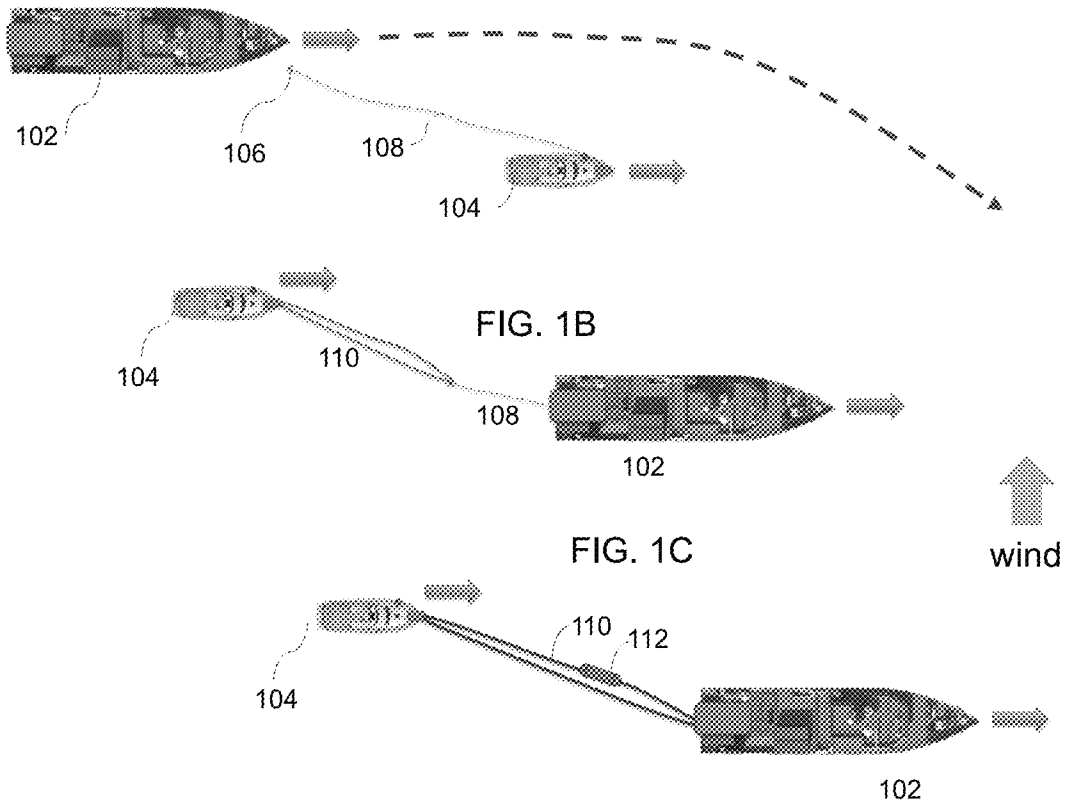
FIGS. 1A, 1B and 1C illustrate a transfer process and environment, according to some embodiments of the disclosed invention.

FIGS. 1A, 1B and 1C illustrate a transfer process and environment, according to some embodiments of the disclosed invention. As shown in FIG. 1A, the sending ship 102 approaches to a safe distance (for example, astern and to the lee) of the unmanned receiving ship 104, taking the wind direction into account. The receiving ship autonomously releases a buoy 106 with attached messenger line 108 (e.g., from its lee side). The sending ship 102 then captures and holds this messenger line. As shown in FIG. 1B, the sending ship maneuvers to pull forward, and to the windward of the receiving ship, while passing the end of the messenger line to the stern. The sending ship then pulls out a looped (floating) carrier line 110 from the receiving ship until it is recovered by the sending ship. In some embodiments, for heavier loads, a stronger transfer cable 110 is used in addition to or in lieu of the carrier line 110.

The ends of the carrier line loop 110 are detached, with one end attached to the messenger line 108 and the other to a transfer winch on the sending ship, which pulls in the messenger line until the carrier line loop 110 is captured by the sending ship 102.

As shown in FIG. 1C, floating payload transfer capsules and/or floating hose/electrical cables 112 are attached to the carrier line 110 and are pulled across by the carrier line 110 via the transfer winch (on the sending ship) to the receiving unmanned ship 104. Once transfers are complete the process is reversed, with the heavier transfer cable recovered by the sending ship 102, and the carrier loop, messenger line and the buoy are autonomously retracted by the receiving ship 104. In some embodiments, a radar or lidar (on the sending ship) may be used to remotely control the steering of the unmanned ship to keep a constant distance between the two ships during the transfer of the materials.

Figure 2A:
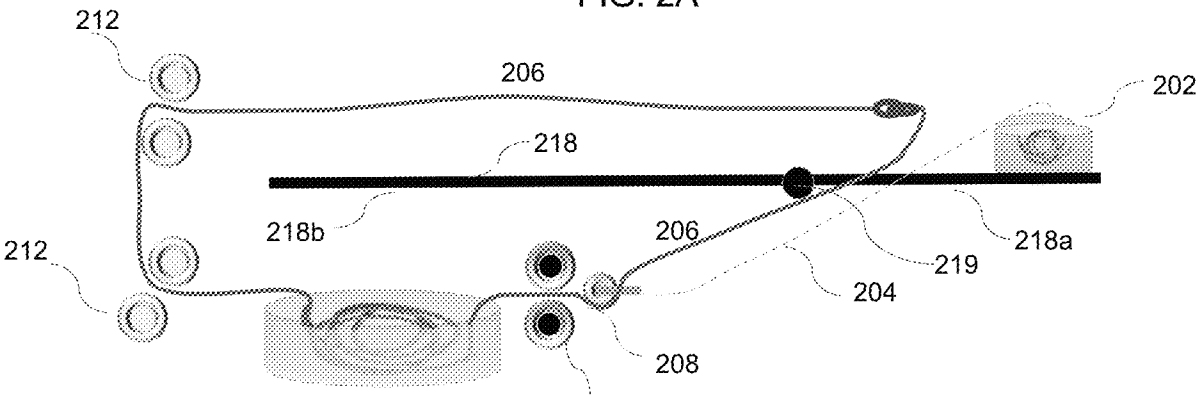
FIG. 2A is a simplified schematic illustrating pulling equipment on an unmanned receiving ship and FIG. 2B depicts a payload capsule attached to the pulling equipment, according to some embodiments of the disclosed invention.
Figure 2B:
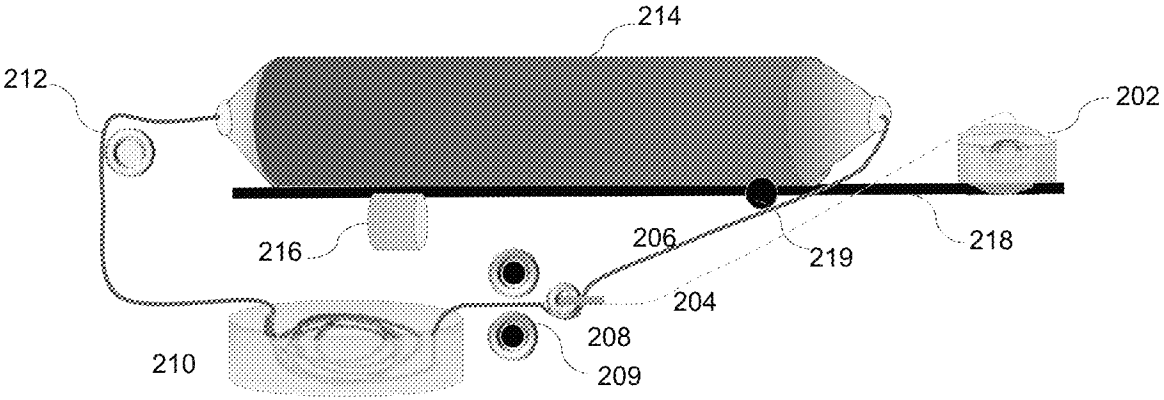

FIG. 2A is a simplified schematic illustrating pulling equipment on an unmanned receiving ship and FIG. 2B depicts a payload casing/capsule 214 in addition to the pulling equipment, according to some embodiments of the disclosed invention. As shown in FIGS. 2A and 2B, a buoy 202 is attached to a messenger line 204 and is released by the unmanned receiving ship to keep the messenger line afloat. In some embodiments, the buoy 202 includes a rope compartment and a line release switch that releases the line, when the line is captured and pulled. In some embodiments, the messenger line 204 is a floating line and therefore eliminating the need for a buoy. The messenger line 204 is attached to a carrier line loop 206 (and/or an optional transfer cable for heavier loads).

The carrier line loop 206 is stored in a line/cable compartment 210 on the unmanned ship and guided by a plurality of guide pulleys 212. The carrier line loop 206 is attached to a cable/line windless operated by remote-controlled motors 209 to retract the line, for example, via one or more pulleys 208, and store it back in the compartment 210, once the transfer of the payload is completed. Typically, a windlass includes a horizontal cylinder (barrel), which is rotated by the turn of a crank or belt (in this case, autonomously). The winch is affixed to one or both ends, where the carrier line loop 206 is wound around it, by the remote-controlled motors 209.

FIG. 2B illustrates an enclosing payload casing or capsule 214 attached to the pulling equipment of FIG. 2A. The payload 214 (in this case, a capsule) may initially reside on the unmanned (receiving) ship or the sending ship. The capsule 214 may be moved or rotated by a motor 216 to control the orientation of the capsule 214 and position the capsule for unloading on the unmanned ship. In some embodiments, the capsule 214 is positioned on a wheeled or bending fetch/release platform 218 on the unmanned ship for unloading or release into the water. The fetch/release platform 218 enables the capsule to roll into the water or retrieved from the water, when the carrier line loop 206 is pulled in or out by the sending ship.

In some embodiments, the fetch/release platform 218 is divided into two portions 218*a* and 218*b*, at a joint 219. Portion 218*a* (for example, at the stern of the receiving ship) bends down at joint 219 and tilts downward, so that the buoy 202 and the (unloaded) capsule 214 are dropped down (by the gravity force) onto the water. In some embodiments, the buoy 202 can be used to provide additional force, by its resistance as it is pulled though the water, to help release the capsule away from the unmanned receiving ship. Once the loaded capsule 214 is returned from the sending ship and positioned at its unloading dock (location) on the receiving ship, a sensor-triggered motor 216 then adjusts the orientation of the loaded capsule for unloading the material, by step-rotating the capsule (e.g., along its longer axis) to position the capsule for each material container therein to be unloaded on the unmanned ship.

One skilled in art would recognize that the autonomous operations on the unmanned ship are controlled by one or more processors, a plurality of sensors coupled to the processors, actuators, switches, motors, windlass and cable lathes controls controlled by the processors. Some operations are triggered by electrical or mechanical position sensors that sense the locations of the capsule, payload and various lines, in order to trigger certain actions controlled by the processor and performed by the motors, actuators, windlass, cable latches and/or switches onboard the unmanned ship. In some embodiments, the sending ship can "log in" into the control system of the unmanned ship and control certain functions to accomplish the transfer via the control systems on the unmanned ship.

Figure 3A:
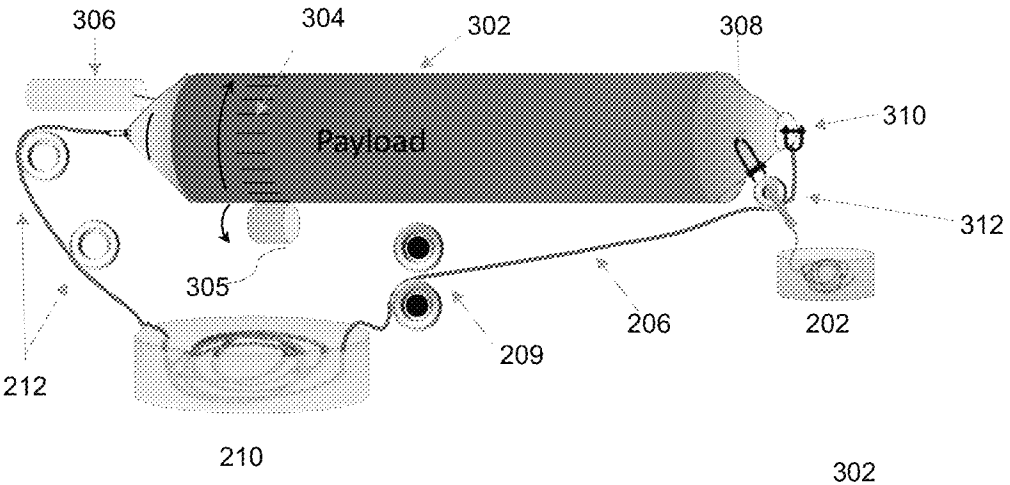
FIG. 3A shows an exemplary payload capsule for carrying transfer materials and FIG. 3B depicts when the payload capsule is being pulled in or out, according to some embodiments of the disclosed invention.
Figure 3B:
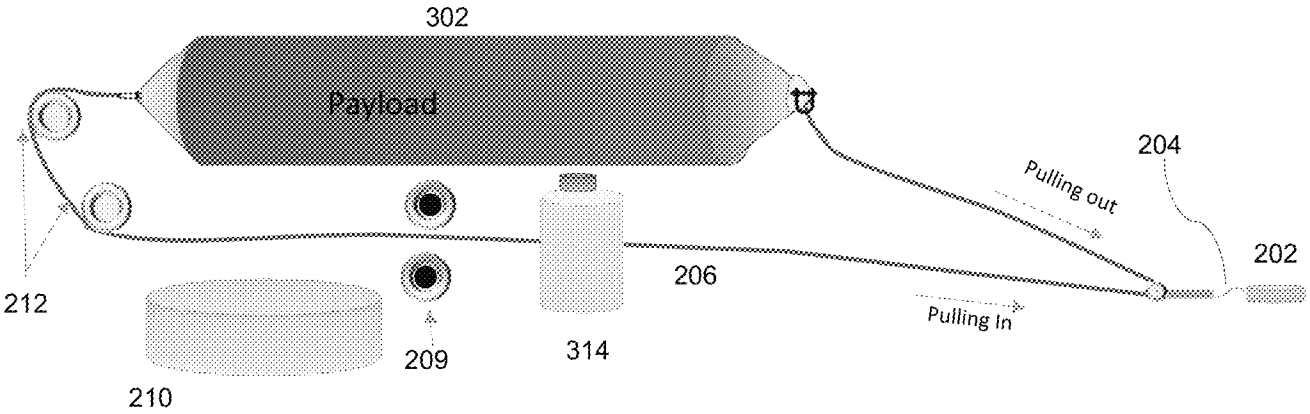

FIG. 3A shows an exemplary payload capsule for carrying transfer materials and FIG. 3B depicts when the payload (e.g., a capsule) is being pulled into or out of the unmanned ship, according to some embodiments of the disclosed invention. Items in FIGS. 3A and 3B with the same reference numerals as those in FIGS. 2A and 2B operate similar to the corresponding items in FIGS. 2A and 2B and therefore are not further described. In FIG. 3A, the payload 302 (in this case, a capsule) is in its docking position for unloading and the carrier loop 206 is stored in the storage compartment 210, while in FIG. 3B, the payload 302 is being pulled in or out by the sending ship to returned to the unmanned ship or the sending ship.

A (horizontal) platform-to-payload interconnect 306 connects to the payload capsule 302 to provide known autonomous unloading functions. The platform-to-payload interconnect 306 may include components such as, sensors, conveyers, windlasses, motors, switches, latches, clamps, stoppers, actuators, robots, cranes, connecting hoses, valves (for fluid transfer), conductive cable and contacts (for electrical energy transfers), and/or similar known components. In some embodiments, the capsule 302 may move and get unloaded vertically, using a vertical platform-to-payload interconnect 314, as shown in FIG. 3B. A more detailed description of platform-to-payload interconnects is provided below with respect to FIGS. 5A & B, 6A & B, 7, 8A& B and 9A& B.

In the example illustrated in FIG. 3A, the buoy 202 is hanging from the payload capsule 302 (instead of being positioned on the fetch/release platform 218, as shown in FIGS. 2A and 2B). In this case, a remote-release shackle/clamp 308 releases the carrier line loop (cable) 206, when the messenger line 204 is being pulled by the sending ship, so that the carrier line loop (cable) can also be pulled via the messenger line. As known in the art, the remote-release shackle/clamp 308 may operate mechanically by applying sufficient pull force, via a (mechanical or electrical) sensor, or by a remotely operated switch to release the carrier line loop (cable) 206. A payload-to-cable (carrier line) shackle/clamp 310 connects the carrier line loop (cable) 206 to the capsule 302 and is released and engaged remotely. A load bearing pulley 312 directs and guides the carrier line loop (cable) 206 to engage to or release form the capsule 302.

A sensor-triggered motor 305 is mechanically or remotely turned on to step through indexes/grooves 304 on the capsule 302 to rotate the capsule (at its longer axis, in this example) to orient the capsule for unloading the material, via the platform-to-payload interconnect 306 or 314. The indexes/grooves 304 on the capsule also help to ensure controlled roll of the capsule. The steps of the motor 305 are configured to orient the capsule to the position of each material container inside of the capsule, so that the material can be positioned at the platform-to-payload interconnect 306. At each indexed orientation, a different (container of) material in the capsule is positioned to an unloading opening and the material is transferred into (or out of) the capsule via the platform-to-payload interconnect 306. The capsule is then rotated to the next index 304 for the next material to be loaded/unloaded. The orientation of the (empty) capsule on the sending ship may also be set similarly for loading the capsule.

FIG. 3B illustrates how capsule 302 is being pulled in or out by the sending ship to dock at the unmanned ship for unloading and pulled out by the sending ship for loading in the sending ship. In this example, when the capsule is being pulled in, the movement direction of the carrier line loop (cable) 206 is counter clockwise, and when the capsule is being pulled out, the movement direction of the carrier line loop is clockwise. In these embodiments, the capsule 302 may move and be unloaded vertically, using a vertical platform-to-payload interconnect 314. In some embodiments, the vertical platform-to-payload interconnect 314 and/or the horizontal platform-to-payload interconnect 306 are similar to the known loading mechanism of a cannon turret in a battleship, as described in the literature, for example, in www.wikipedia.org; or similar to loading and unloading of goods in an automated warehouse or port. In some embodiments, the force for pulling the carrier line loop for loading/unloading capsule from/onto unnamed ship may be generated by a motor on the unmanned ship.

Figure 4A:
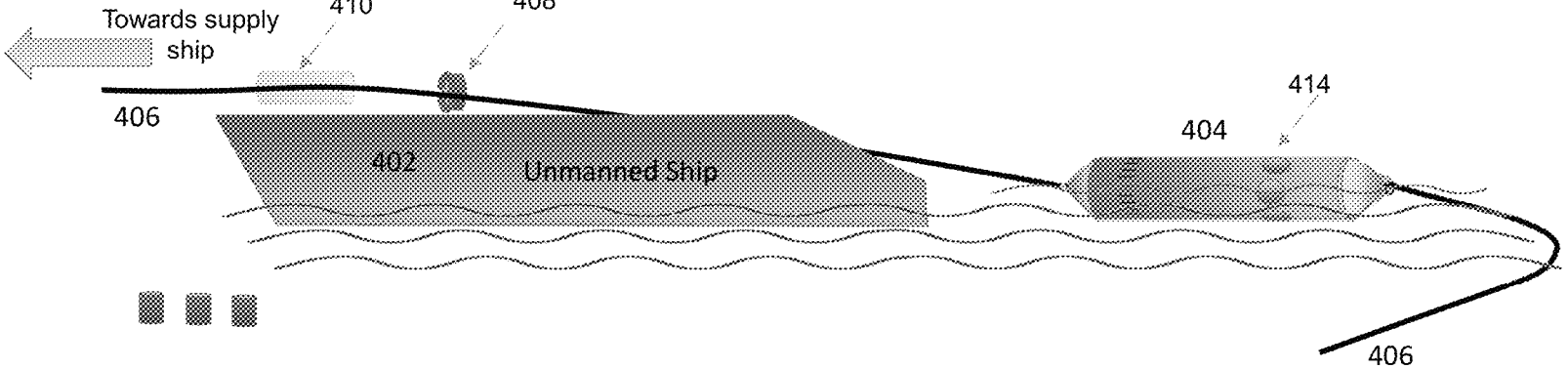
FIG. 4A schematically depicts a side view and FIG. 4B schematically depicts a top view of load and unload operations for a payload casing/capsule, according to some embodiments of the disclosed invention.
Figure 4B:
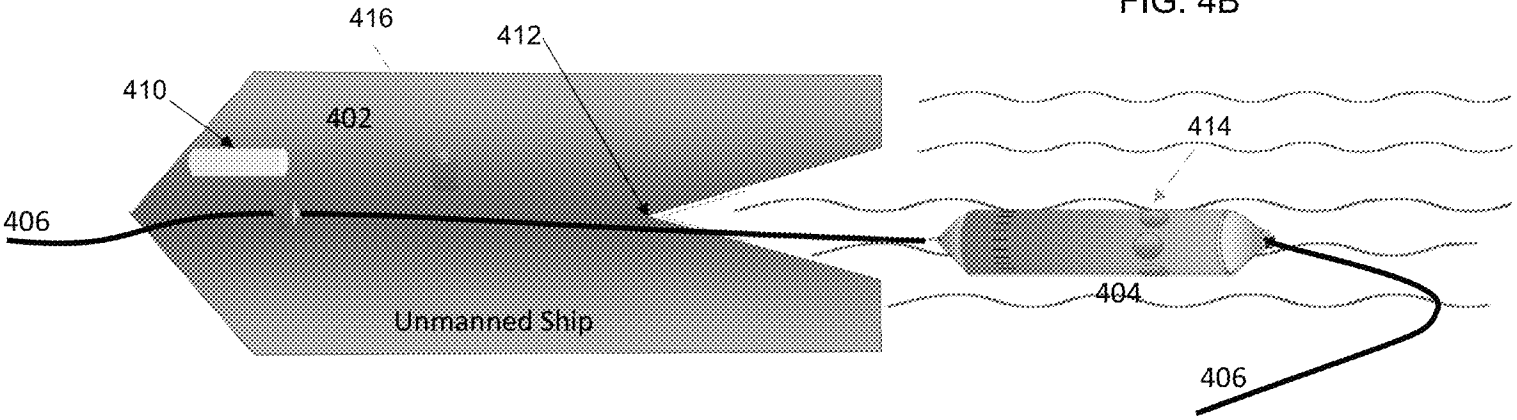

FIG. 4A schematically depicts a side view and FIG. 4B schematically depicts a top view of load and unload operations for a payload casing/capsule 404, according to some embodiments of the disclosed invention. As illustrated, capsule 404, containing loads of material 414 (typically placed in smaller canisters or containers), is being autonomously pulled in on an unmanned (receiving) ship 402 by a sending ship, via a carrier loop (cable) 406 through some line (cable) guides 408, for example, rope rings, pulleys and/or grooves. Rope rings help in the alignment of the capsule to platform-to-payload interconnect 410. They could be fixed or adjustable for multi-function purposes.

In addition, the guides (rings) 408 can employ "tension-latch" to help hold the unmanned ship into position across the carrier line loop. For example, a closed ring would stop the carrier loop (cable) 406 movement against the receiving unmanned ship such that the capsule and the receiving ship distance are kept constant. An open ring (guide) would also allow a free carrier loop (cable) 406 movement such that the forward movement of supply (sending) ship can be used to load the capsule onto unmanned (receiving) ship, when the receiving ship is kept at lower speed than the supply ship. This approach can complement the use of a windlass on the sending ship, or eliminate it.

In some embodiments, as the capsule 404 gets closer to the receiving ship 402, carrier loop 406 settles into a groove 412 at the stern of the receiving ship and position the capsule in a desire track to be docked into an unloading position on the receiving ship. In these embodiments, the shape of the unmanned ship (autonomous vessel) is designed such that it aligns the payload capsule appropriately to the platform-to-payload interconnect 410, via the guides 408. However, the proper alignment may be achieved via a combination of add-on guides, without having the groove 416 at the stern of the receiving ship. In some embodiments, the guide and alignment mechanism is similar to a well-known boat trailer with rollers that guide a boat on or off the trailer. The combination of guides and the shape of the "unloading-dock" of the unmanned ship ensure yaw and pitch orientation of the capsule and its proper alignment.

Once the capsule 404 is docked at its docking (final) unloading position, an unloading apparatus is triggered to start unloading the loads of material 414 via the platform-to-payload interconnect 410, and secure the unloaded materials 416 in a location on the receiving ship. Once the capsule is unloaded, it is pulled back by the sending ship and stored therein, or used to transfer another set of materials 414.

In the cases when the sending ship is also an unmanned ship, the loading process of the capsule on the receiving ship is similar to the reverse of the unloading process on the unmanned sending ship, using similar equipment (on the sending ship), as described above.

Materials to be transferred can be fluid such as fuel or water, containerized or crated such as batteries or ammunition, or electric energy, for example, for charging batteries on the unmanned ship. Fluid transfer may employ gravity or pumping, while container transfers may employ various existing schemes as described above.

Figures 5A, 5B:
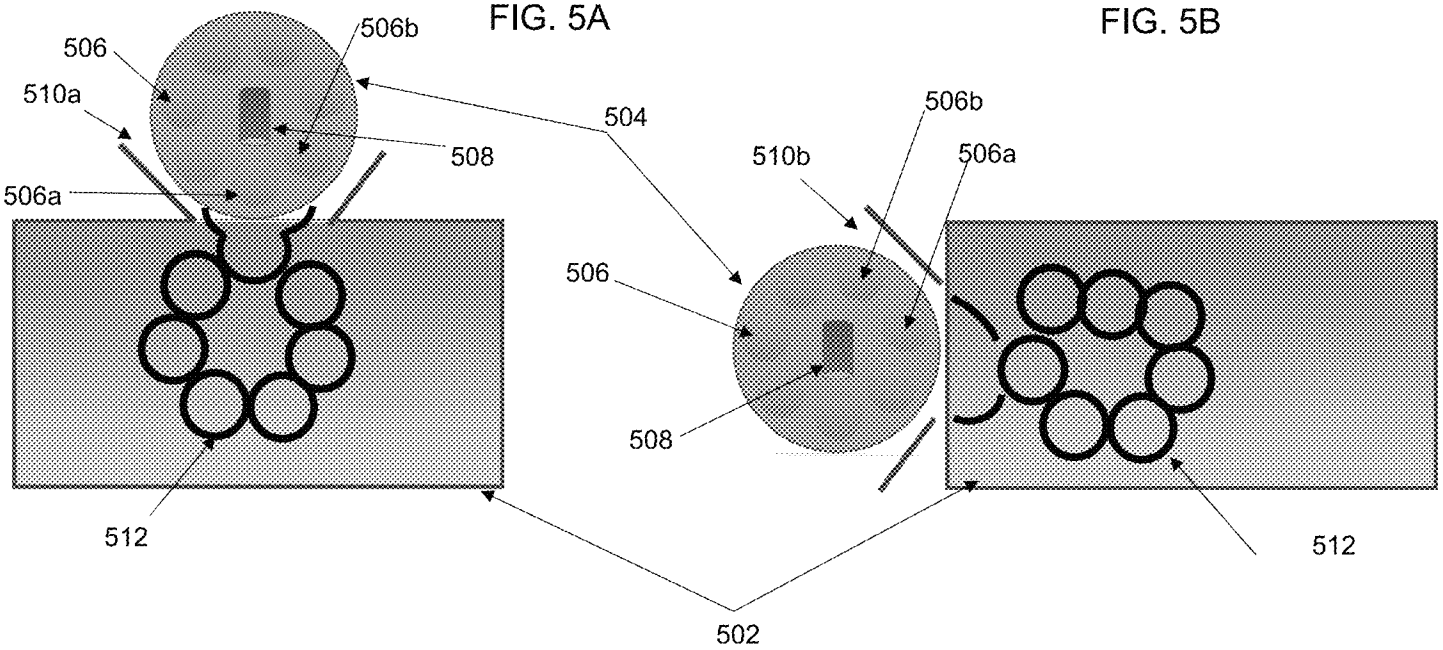
FIG. 5A depicts a bottom autonomous unloading of material containers and FIG. 5B shows a front autonomous unloading of material in an unmanned ship, according to some embodiments of the disclosed invention.

FIG. 5A depicts a bottom autonomous unloading of material containers and FIG. 5B shows a front autonomous unloading of material in an unmanned ship, according to some embodiments of the disclosed invention. When a payload capsule 504 containing transfer material 506 is docked and properly positioned and connected to a platform-to-payload interconnect on the unmanned ship 502 for unloading, a first material 506*a* is autonomously released by a self or remote-triggering switch 508 and unloaded into an opening (510*a* and 510*b*) in the platform-to-payload interconnect, using various autonomous unloading mechanism, for example, those known for automated warehouses or commercial ports. The unloaded materials 512 on the unmanned ship 502 is repositioned to make room for the next material to be release by the release switch 508 and unloaded from the capsule 504. The capsule is then repositioned (e.g., rotated) by a motor (e.g., sensor-triggered motor 305 in FIG. 3A) to position the next material 506*b* aligned with the openings (510*a* and 510*b*) and unload the next material 506*b*, until all the materials 506 in the capsule 504 are unloaded on the unmanned ship.

FIG. 5A depicts a bottom loading/unloading mechanism, where the platform-to-payload interconnect is a vertical platform (e.g., 314 in FIG. 3B). In this case, the unloading mechanism may utilize the force of gravity to unload the material into opening 510A. FIG. 5B illustrates a front unloading mechanism, where the platform-to-payload interconnect is a horizontal platform (e.g., 306 in FIG. 3A). In this case, the unloading mechanism may utilize an automated hydraulic, pneumatic, magnetic and/or electric force to push materials 506 from the capsule into the opening 506*b*, similar to known mechanisms, for example, in warehouses or assembly lines. In some embodiments, the unloading of material containers from the payload capsule and loading them on the unmanned ship is similar to ammunition being loaded into a revolver, as the chamber rotates.

In some embodiments, materials (e.g., waste or empty containers) can be loaded to the capsule on the unmanned ship to be unloaded on the sending ship, using similar unloading equipment on the unmanned ship.

Figure 6A:
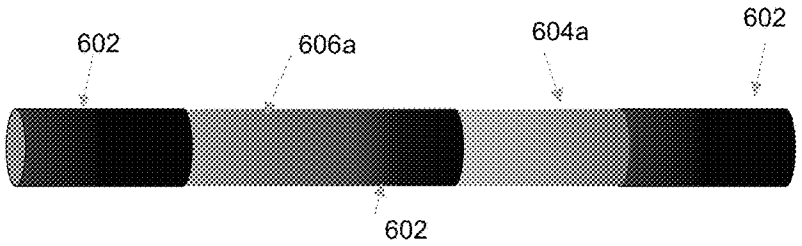
FIG. 6A shows an exemplary cable and FIG. 6B illustrates an exemplary platform for autonomous electrical connection to an unmanned ship, according to some embodiments of the disclosed invention.
Figure 6B:
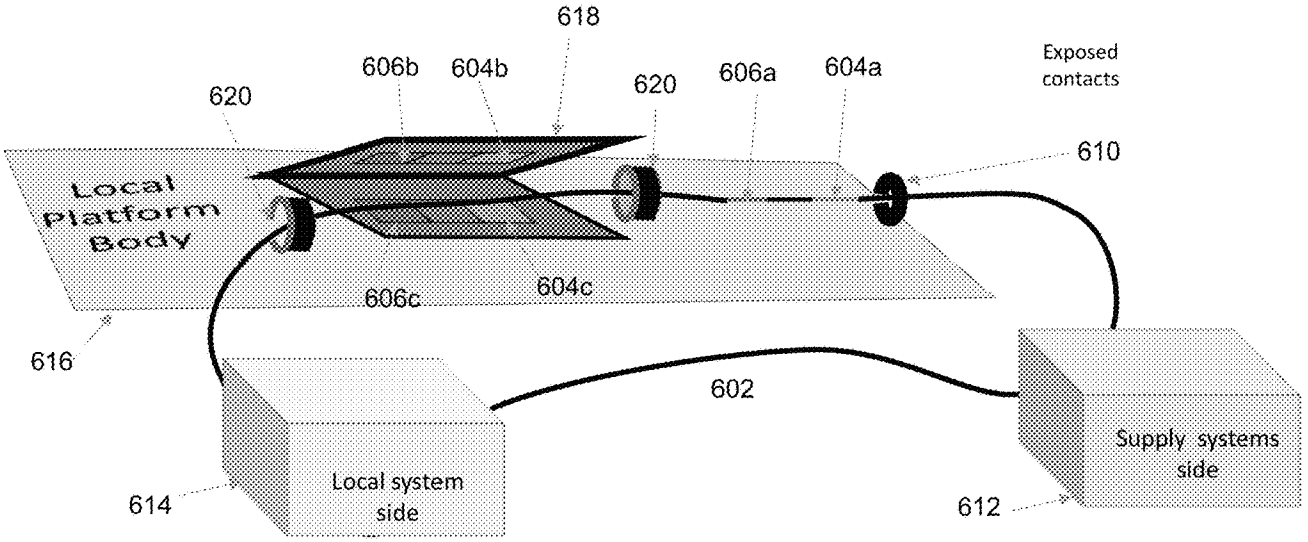

FIG. 6A shows an exemplary conducting cable and FIG. 6B illustrates an exemplary platform 616 for autonomous electrical connection to an unmanned ship, according to some embodiments of the disclosed invention. The electric supply may be needed to charge batteries on the unmanned ship or to provide electrical energy for certain functions on the unmanned ship. Conducting cable 602 may be the same as the carrier loop (e.g., carrier loop 206 in FIGS. 2A and 3A), the messenger line, or a standalone cable attached to a carrier loop. As shown in FIG. 6A, the conducting cable 902 includes two electrical contact areas, 604*a* and 606*a*. Contact area 604*a* may be a metalized ring (e.g., brass or copper) connected to a positive terminal both on the supply system 612 (sending ship) side and the local system 614 (unmanned ship) side. Similarly, contact area 606*a* may be a metalized ring (e.g., brass or copper) connected to a negative terminal both on the supply system 612 side and the local system side 614.

As depicted in FIG. 6B, a local (docking) platform 616 for the cable 602 receives and properly positions the cable 602 for electrical connection to the unmanned ship. As shown, cable 602 loops around through the supply system side 612 and local system side 614, supported by a plurality of guides 620 to ensure cable direction alignment with the contact areas of the clamp. A clamp (or other known fastening mechanisms) 618 on the local platform 616 closes and makes contacts with the contact areas 604*a* and 606*a* of the cable 602, when the cable (loop) is pulled in and properly positioned within the clamp 618. For example, as the cable 602 is being pulled (by the sending ship) and goes through the clamp 618, a mechanical stopper or sensor 610 stops the pulling of the cable when it is detected that the cable is in the appropriate position in the clamp 618.

Clamp 618 includes four contact areas, where 604*b* and 604*c* contact areas need to make contact to the positive terminal contact area 604*a* on the conductive cable 602, and 606*b* and 606*c* contact areas need to make contact to the negative terminal contact area 606*a* on the cable. Accordingly, the stopper or sensor 610 stops the conductive cable 602 when the (positive terminal) contact area 604*a* on the conductive cable is aligned with contact areas 604*b* and 604*c* in the clamp; and the (negative terminal) contact area 606*a* on the cable is aligned with contact areas 606*b* and 606*c* in the clamp. The clamp then closes (remotely or automatically) and seals the contacts. Sealing the contacts in the clamp helps to prevent continuously electrolysis on the contact area due to moisture, which causes deuteriation of the metallic contacts. Any remaining water on the contacts is expelled with sheer pressure from the closed clamp.

The alignment of the cable 602 with contact areas in the clamp may be determined by imaging, magnetic contacts, sensors or mechanically. Once the contacts are made and sealed, the sending ship starts injecting electrical energy into the conducting cable 602 to be supplied to the unmanned ship via the contacts in the clamp 618. An automated electrical charger for autonomous platforms is described in detail in U.S. Pat. No. 9,973,014, the entire contents of which is herein expressly incorporated by reference. Moreover, a system and method for electrical charge transfer across a conductive medium is described in detail in U.S. Pat. No. 9,583,954, the entire contents of which is herein expressly incorporated by reference.

Figure 7:
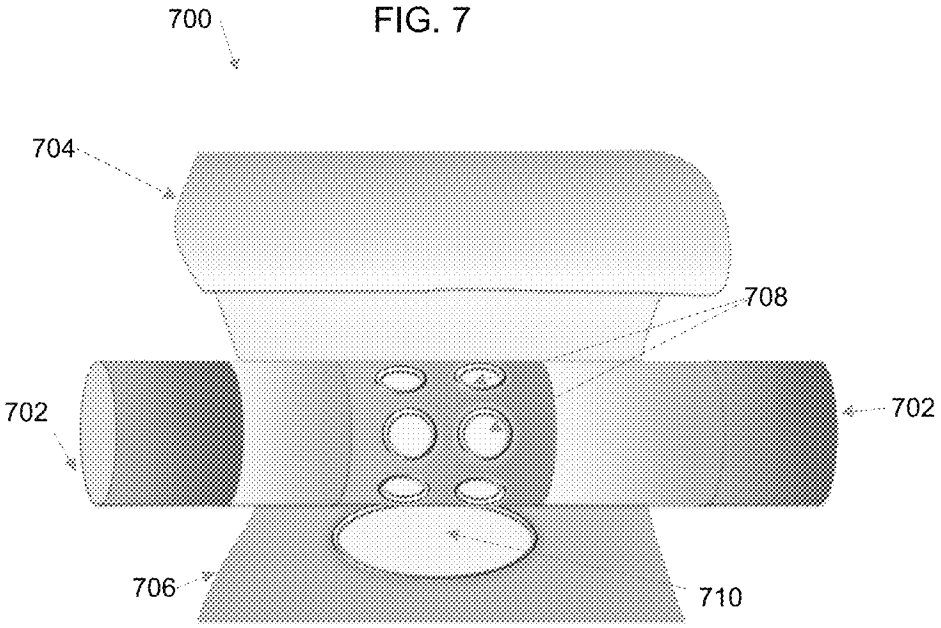
FIG. 7 illustrate an exemplary platform for autonomous fluid connection to an unmanned ship, according to some embodiments of the disclosed invention.

FIG. 7 illustrate an exemplary platform 700 for autonomous fluid connection to an unmanned ship, according to some embodiments of the disclosed invention. As shown, a clamp 704 closes and seals a hose 702 that carries fluid, such as fuel, water, battery fluid, oil, and the like, from the sending ship. The hose is coupled to the messenger line or the carrier loop and is autonomously retrieved and positioned by the unmanned ship, as described above. Hose 702 includes a plurality of openings 708 at its certain area around its circumference. Platform 700 includes a fluid receiving side 706 with an opening 710 that needs to be aligned with and sealed with one or more of the openings 708. As the hose 702 is properly positioned inside the clamp 704, for example, using the alignment methods described above, at least one of the openings 708 is aligned with the opening 710 to dispense the fluid into a fluid reservoir on the unmanned ship. The remaining openings 708 are sealed within the clamp and thus cannot dispense the fluid.

Having multiple (redundant) opening 708 on the hose, makes the alignment of the house with the fluid receiving side (opening 710) on the unmanned ship easier. Since only one opening 708 is needed to dispense the fluid into the opening 710, if the angular positioning of the hose is not very accurate, there still exists at least one opening 708 that aligns with the opening 710 to dispense the fluid.

In some embodiments, the hose 702 is similar to the gas station fuel hose, but may be larger in diameter to accommodate increased fluid flow. The openings 708 and 710 are normally closed. Similar to the electrical connection described above, the operation and alignment of the house may be accomplished by imaging, magnetic contacts, sensors or mechanically. In some embodiments, the fluid hose and the conductive cable (of FIG. 6A) can be combined into a single line, where the connection and contact locations are positioned at different location on the combined line. In some embodiments, the fluid hose, the conductive cable, and/or the combined line may be combined with the carrier loop.

FIGS. 8A and 8B depict an exemplary inline valve 800 for autonomous dispensing fluid, according to some embodiments of the disclosed invention. FIG. 8A shows the inline valve being closed and FIG. 8B illustrates the inline valve being opened. As shown, a plurality of openings 804 on a hose 802 are being opened (FIG. 8B) and closed (FIG. 8A) by the inline valve. The valve includes a cylindrical disk 806 at one end, a stem 810 with a spring 808 and a wheel 812 at the other end. When the valve is closed, the cylindrical disk 806 closes and seals the openings 804 on the hose and therefore prevents the fluid flow through the openings (FIG. 8A). The direction of the fluid flow is from right-hand side to the left-hand side of the figures. When the valve is opened, the cylindrical disk 806 moves away and opens the openings 804 on the hose and therefore enables the fluid flow through the openings (FIG. 8B).

Since the valve is positioned inside (inline) of the hose, these embodiments do not require a continuous loop for the hose. That is, one end of the house may be terminated at the docking position on the unmanned ship, while the other end is at the sending (supply) ship. The valve may be operated (opened and closed) remotely, magnetically, mechanically or by the fluid pressure (or lack thereof).

FIGS. 9A and 9B illustrate an exemplary perpendicular valve 900 for autonomous dispensing fluid, according to some embodiments of the disclosed invention. In these embodiments, each opening (e.g., 708 in FIG. 7) includes its owned (perpendicular) valve and therefore the opening and closing of the openings 906 can be individually controlled. When the perpendicular valve 900 is in an opened configuration (FIG. 9A), the disk 904 retracts and opens the opening 906 to allow the flow of the fluid. Conversely, when the perpendicular valve 900 is in a closed configuration (FIG. 9A), the disk 904 protracts and closes the opening 906 to prevent the flow of the fluid. Similar, to the inline valve of FIGS. 8A and 8B, the perpendicular valve 900 may be operated (opened and closed) remotely, magnetically mechanically or by the fluid pressure (or lack thereof).

In some embodiments, when the sending ship is also an unmanned ship, the loading process of the capsule or fluid in the sending ship is the reverse of the unloading process on the unmanned receiving ship, using similar equipment in the sending ship, as described above. In some embodiments, materials (e.g., waste or empty containers) can be loaded to the capsule on the unmanned ship to be unloaded on the sending ship, using similar unloading equipment on the unmanned ship.

It will be recognized by those skilled in the art that various modifications may be made to the illustrated and other embodiments of the invention described above, without departing from the broad inventive step thereof. It will be understood therefore that the invention is not limited to the particular embodiments or arrangements disclosed, but is rather intended to cover any changes, adaptations or modifications which are within the scope of the invention as defined by the appended drawings and claims.

What is claimed is:

1. An autonomous loading or unloading system for transferring material to or from an unmanned ship comprising:

a messenger line for being pulled by the unmanned ship;

a carrier line loop coupled to the messenger line for being pulled by the unmanned ship, wherein a payload is coupled to the carrier loop for transferring the material to or from the unmanned ship;

a loading/unloading dock for the payload;

a plurality of line guides for guiding the carrier loop, wherein the carrier line loop is pulled by the sending ship in a first direction to move the payload from the unmanned ship, and pulled in a second direction opposite to the first direction to move the payload to the unmanned ship; and a platform-to-payload interconnect for autonomous loading or unloading of the material from/to the payload.

2. The autonomous loading or unloading system of claim 1, wherein the payload is a capsule for transferring containerized or crated material.

3. The autonomous loading or unloading system of claim 1, wherein the payload is a hose for transferring fluid.

4. The autonomous loading or unloading system of claim 1, wherein the payload is a conducting cable having a first cable terminal contact area and a second cable terminal contact area for transferring electrical energy.

5. The autonomous loading or unloading system of claim 2, further comprising a sensor-triggered motor for moving the capsule to align a capsule orientation with the platform-to-payload interconnect for autonomously loading or unloading the containerized or crated material.

6. The autonomous loading or unloading system of claim 2, wherein the platform-to-payload interconnect is horizontal or vertical.

7. The autonomous loading or unloading system of claim 5, wherein the platform-to-payload interconnect includes a moving chamber for each of the containerized or crated materials, and wherein the capsule includes a release switch for releasing said each of the containerized or crated materials onto a respective chamber, when the capsule is oriented by the sensor-triggered motor to align said each of the containerized or crated materials with an empty chamber.

8. The autonomous loading or unloading system of claim 5, wherein the platform-to-payload interconnect includes a moving chamber, and wherein the capsule includes a release switch for releasing a content of the capsule onto the moving chamber when the capsule is oriented by the sensor-triggered motor to align with the moving chamber.

9. The autonomous loading or unloading system of claim 3, wherein the platform-to-payload interconnect is a clamp that closes and seals the hose for loading or unloading the fluid.

10. The autonomous loading or unloading system of claim 9, wherein the hose includes a plurality of hose openings at a predetermined area around its circumference and the clamp includes a fluid receiving side with a receiving opening, wherein at least one of the hose openings is aligned with the receiving opening to autonomously dispense the fluid into a fluid reservoir.

11. The autonomous loading or unloading system of claim 10, further comprising an inline valve in the hose for allowing or preventing the fluid to be dispensed from the hose.

12. The autonomous loading or unloading system of claim 10, further comprising a perpendicular valve in each of the hose openings for allowing or preventing the fluid to be dispensed from the hose.

13. The autonomous loading or unloading system of claim 4, wherein the platform-to-payload interconnect is a clamp including a first clamp terminal contact area and a second clamp terminal contact area that closes and seals the conducting cable for transferring the electrical energy.

14. The autonomous loading or unloading system of claim 13, wherein the conducting cable is stopped by a sensor when the first cable terminal contact area and the second cable terminal contact area are aligned with the first clamp terminal contact area and the second clamp terminal contact area, respectively.

15. An autonomous method for loading or unloading material on or form an unmanned ship comprising:

pulling a messenger line;

autonomously pulling a carrier line loop coupled to the messenger line, wherein a payload is coupled to the carrier loop for transferring the material;

autonomously guiding the carrier loop by a plurality of line guides, wherein the carrier line loop is autonomously pulled in a first direction to move the payload from the sending ship to the unmanned ship, and autonomously pulled in a second direction opposite to the first direction to move the payload from the unmanned ship to the sending ship; and autonomously loading or unloading the material from/to the payload via a platform-to-payload interconnect.

16. The autonomous method of claim 15, wherein the payload is a capsule for transferring containerized or crated material.

17. The autonomous method of claim 15, wherein the payload is a hose for transferring fluid.

18. The autonomous method of claim 15, wherein the payload is a conducting cable having a first cable terminal contact area and a second cable terminal contact area for transferring electrical energy.

19. The autonomous method of claim 16, further comprising moving the capsule by a sensor-triggered motor to align a capsule orientation with the platform-to-payload interconnect for autonomously loading or unloading the material.

20. The autonomous method of claim 16, wherein the platform-to-payload interconnect is a clamp including a first clamp terminal contact area and a second clamp terminal contact area that closes and seals the conducting cable for transferring the electrical energy.

* * * * *